US005813672A

United States Patent [19]

Loud, Jr.

[11] Patent Number: 5,813,672

[45] Date of Patent: Sep. 29, 1998

[54] WORD PUZZLE AND GAME

[76] Inventor: Jewel O. Loud, Jr., 2518 Jackson St., La Marque, Tex. 77568

[21] Appl. No.: 896,130

[22] Filed: Jul. 17, 1997

[51] Int. Cl.[6] ..... A63F 3/00

[52] U.S. Cl. ..... 273/272; 273/299; 273/429

[58] Field of Search ..... 273/272, 429, 273/292, 299, 153 R

[56] References Cited

U.S. PATENT DOCUMENTS

| | | | |
|---|---|---|---|
| 5,429,371 | 7/1995 | Bledsoe | 273/272 |
| 5,603,504 | 2/1997 | Powell | 273/272 |
| 5,645,280 | 7/1997 | Zelmer | 273/272 |

*Primary Examiner*—William M. Pierce

*Attorney, Agent, or Firm*—Goldstein & Canino

[57] ABSTRACT

A word puzzle game is disclosed. The word puzzle game comprises a rectangular word puzzle card having a matrix of grid spaces surrounding the outer periphery. The matrix of grid spaces frame and surround a display area, where a plurality of character letters which comprise a word are positioned for a player to decipher. Certain information which lends assistance to the player in deciphering the word contained within the display area is provided in the matrix of grid spaces. A game board having a series of progress spaces is supplied with the word puzzle card, and each player moves forward along a path of the progress spaces towards an ultimate winning position in relation to the number of times the player successfully deciphers the word encrypted within the display area.

6 Claims, 7 Drawing Sheets

CODESIGN KEY

WORD PUZZLE AND GAME

BACKGROUND OF THE INVENTION

The invention relates to a word puzzle and corresponding board game. More particularly, the invention relates to a word puzzle wherein words or a plurality of words are encrypted within a specified area, and must be deciphered by a player or players to test said player's mental acuity.

Word puzzles and other games which test a player's mental acuity are well known in the prior art. Many of these puzzles or games, for instance, are instilled in individuals at a young age, for educational as well as recreational purposes. Most of these educational-recreational puzzles and games typically fail to provide true mental stimulation or conditioning, however. For instance, many of the prevalent computer aided games found on the market attempt to stimulate an individual's mental ability, but tend only to heighten hand-eye coordination. Logic-type puzzles and games are also aimed at increasing mental acuity, but tend often to be aggravating and frustrating. While these units may be suitable for the particular purpose employed, or for general use, they would not be as suitable for the purposes of the present invention as disclosed hereafter.

SUMMARY OF THE INVENTION

It is an object of the invention to produce a word puzzle wherein a plurality of letters are arranged in various configurations to form a word or plurality of words.

It is a further object of the invention to provide a word puzzle wherein a word puzzle card possesses a matrix of spaces disposed about the card's outer periphery, and information relating to the arrangement and configuration of letter characters contained within the center of the card is found within said matrix of spaces.

It is another object of the invention to produce a word puzzle which increases mental agility and acuity of a player, while at the same time providing a stimulating form of recreation and entertainment.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
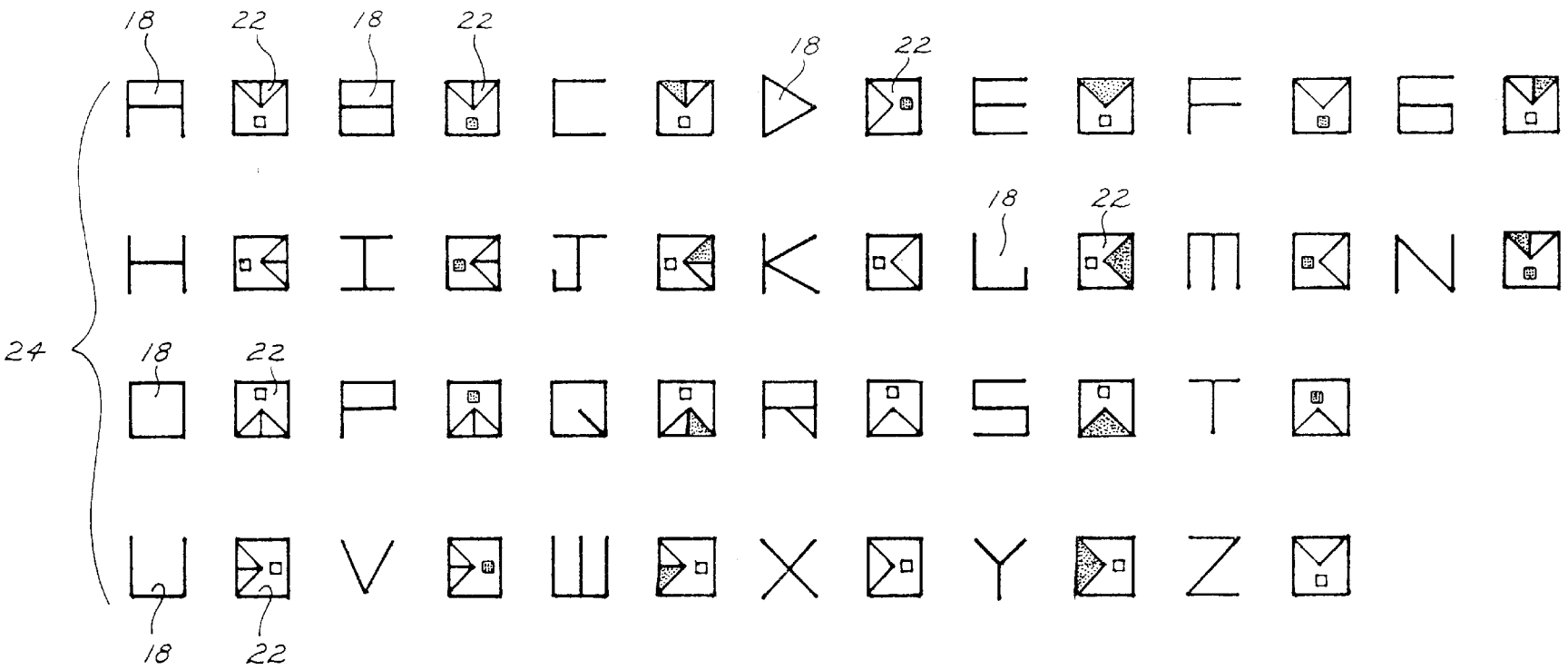
FIG. 1 is an illustration of codes which are used to represent letter character indicia upon word puzzle cards of the instant invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the word puzzle card.

Figure 3:
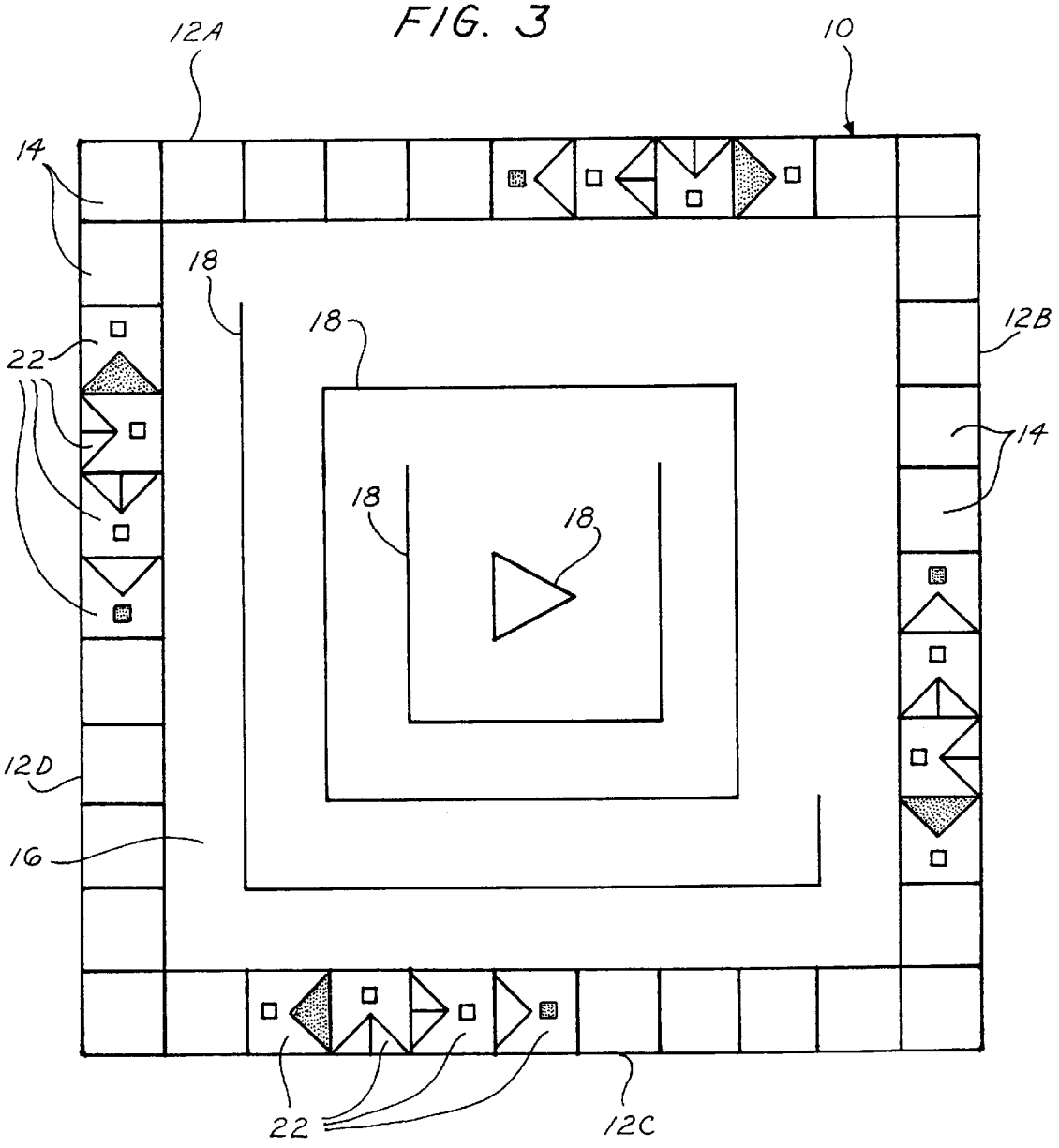
FIG. 3 illustrates a word puzzle card of the instant invention, with a matrix of spaces disposed about the periphery thereof, and information relating to the arrangement and configuration of letter characters contained within the center of the card found within a selection of said spaces.

Reference in this specification will begin first with regards to FIG. 3, which illustrates a word puzzle card 10 of the instant invention. It can be seen that the word puzzle card 10 is essentially rectangular in shape, having four sides 12A, 12B, 12C and 12D. In addition, information relaying means, such as a matrix of grid spaces 14 surround the entire outer periphery of the word puzzle card 10. In FIG. 3 and all other FIGS used throughout, a total of forty matrix spaces are shown to surround the word puzzle card 10. Various other embodiments of the word puzzle card 10 are envisioned, however, such that the word puzzle card 10 is not limited to being rectangular in shape, nor must the information relaying means such as the matrix of grid spaces 14 surround the entire outer periphery and consist of forty spaces.

Referring still to FIG. 3, the word puzzle card 10 shown thereat further consists of a display area 16, said display area 16 framed by the information relaying means such as the matrix of grid spaces 14. Letter characters 18 are placed within the display area 16 in various orientations, said letter characters 18 arranged to spell a pre-determined word or plurality of words.

The letter characters 18 are placed within the display area 16 so that they never overlap. In addition, the letter characters 18 are nested within the display area 16 such that the letter character 18 located in the outermost area of the display area 16 (i.e. the letter character 18 closest to the edge 12 of the word puzzle card 10) is largest in size with respect to the other letter characters 18 found within the display area. Successive letter characters 18 are placed in distinct zones progressively closer to the geometric center of the word puzzle card 10, with each successively inwardly approaching letter character 18 smaller than the previously, more outwardly placed letter character 18, such that said letter characters 18 never overlap. In another contemplated preferred embodiment the letter characters 18 may be located in distinct zones of the display area 16 (such as by dividing the display area 16 into quadrants) so that a plurality of independent words may be encrypted upon any one particular word puzzle card 10.

The letter characters 18 can be arranged to spell a particular phrase beginning from the card edges 12 proximal to the matrix of grid spaces 14 and ending towards the center of the card 10, or beginning proximal to the center and expanding outward towards the card edges 12. In FIG. 3, beginning from the card edges 12 and reading inward towards the center, the phrase "LOUD" can be recognized.

It should be understood that the letter characters 18 as seen in FIG. 3 can be arranged within the display area 16 such that they are read properly by orienting the word puzzle card so that the edge 12A is positioned at the top. It should also be understood that certain letter characters 18 may be properly read by orienting the word puzzle card 10 so that the edge 12A is positioned at the top, (such as the character letters "O" and "U" found in the display area 16 of FIG. 5) while the proper reading of other character letters 18 may require the word puzzle card 10 to be rotated so that an alternate edge 12 is positioned on the top. While still referring to FIG. 5, for example, it is seen that the character letter "L" is properly read by orienting the card such that the edge 12B is located at the top, while the character letter "D" is properly read by orienting the card such that the side 12D is situated at the top.

Figure 2:
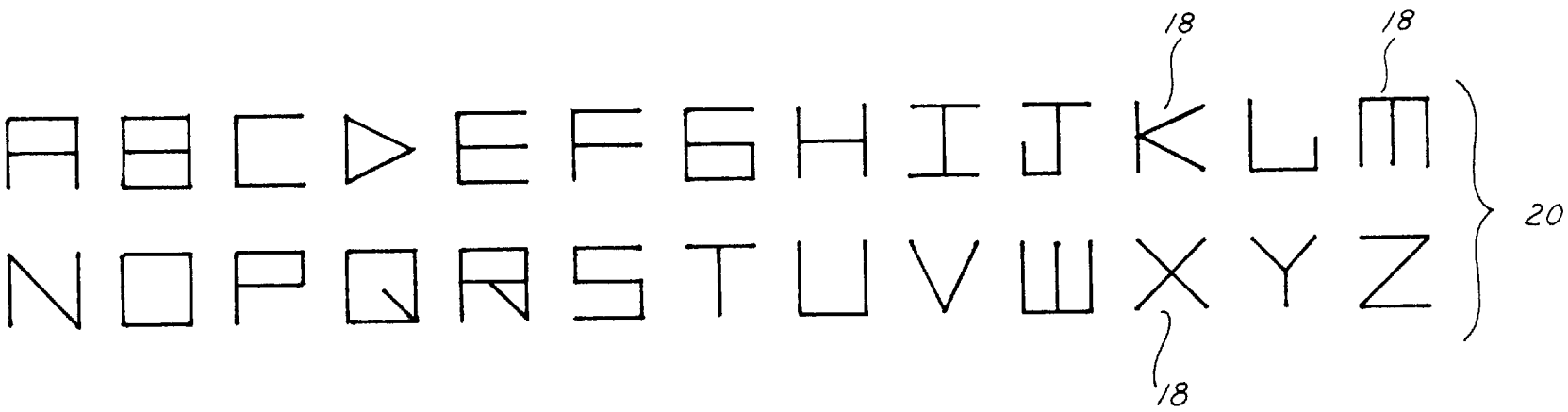
FIG. 2 is a listing of the letter character indicia which are placed within the center of the word puzzle cards of the instant invention.

The object of the instant invention is to decipher the variously arranged letter characters 18 which are placed within the display area 16, and thus decipher the word or phrase which is spelled thereat. A standard font or typography will be employed upon the word puzzle cards 10 to ensure consistency. It is contemplated in the preferred embodiment of the instant invention that a standard letter character alphabet 20 as seen in FIG. 2 be provided along with the word puzzle cards 10, so that potential players can fully recognize the styles of the letter characters 18 which comprise the words the players are attempting to decipher.

The information relaying means, such as the matrix of grid spaces 14 shown surrounding the outer periphery of the word puzzle card 10 in FIG. 3 are intended to provide clues and related information to the player regarding the word or phrase which is configured within the display area 16 of the card 10. For instance, information of a highly probative value can be supplied thereat, as seen in FIG. 3. There it can be seen that the matrix of grid spaces 14 located at each of the four sides 12 of the word puzzle card 10 possess a plurality of symbols 22. By referencing a supplied codesign key chart 24 such as that shown in FIG. 1, a player would be able to decipher each symbol 22 into the corresponding letter characters 18 assigned thereto. By reading, in order from left to right, the symbols 22 found within the matrix of grid spaces 14 of each edge of the word puzzle card 10, a player would decipher the word "LOUD". This would indicate to the player that the phrase "LOUD" is found within the display area 16 of the word puzzle card 10.

Figure 4:
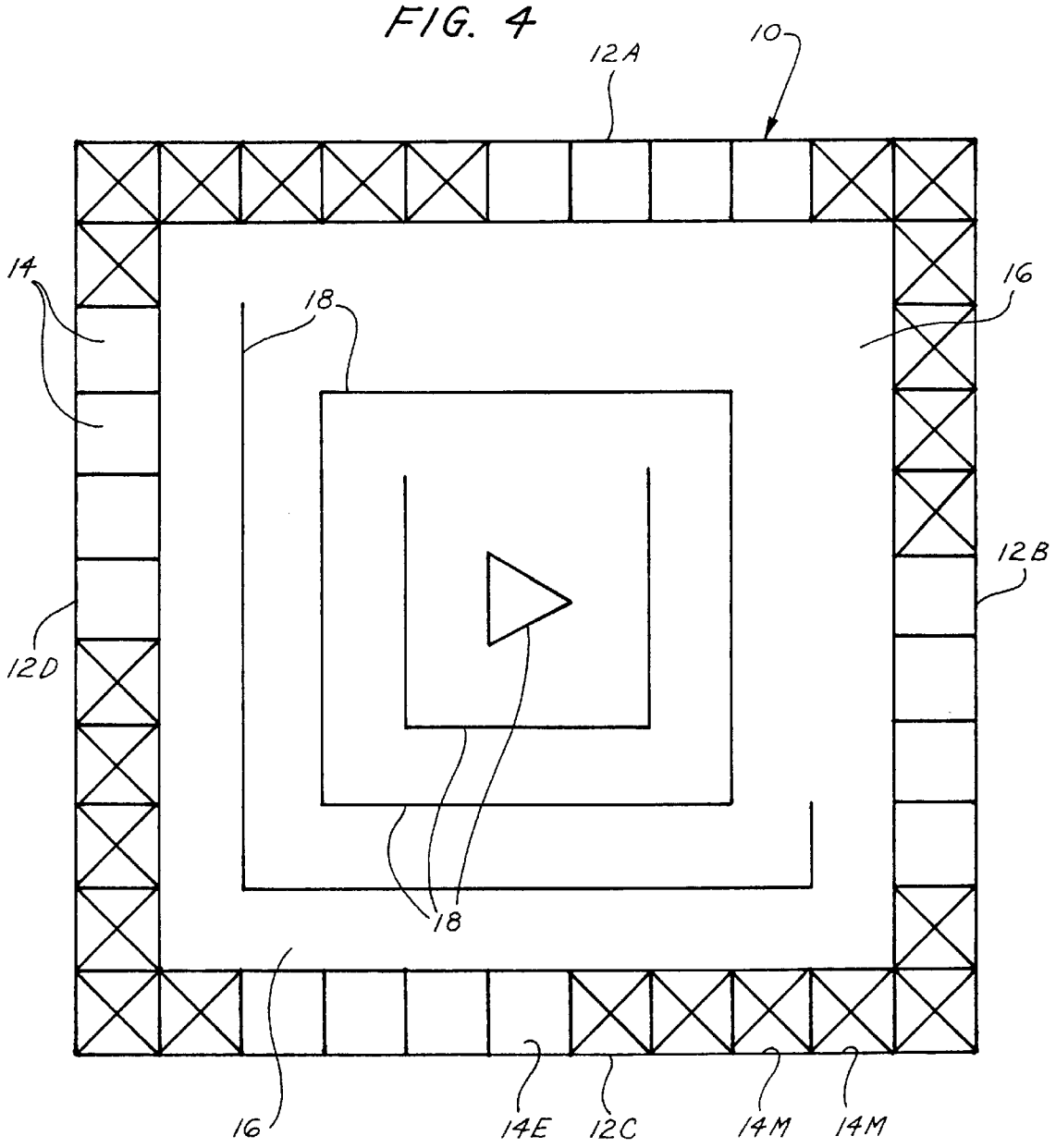
FIG. 4 illustrates another word puzzle card of the instant invention, with alternative information relating to the arrangement and configuration of letter characters contained within the center of the card found within the matrix of spaces.

Various other sources of information may also be provided by the information relaying means (i.e. the matrix of grid spaces 14) pertaining to the word or phrase which the letter characters 18 within the display area 16 comprise. For instance, in FIG. 4 a plurality of grid spaces 14M are filled with an "x" mark, while a number of grid spaces 14E are left unmarked. The number of unmarked adjacent grid spaces 14E (four as seen in FIG. 4) correctly indicate that the phrase contained within the display area 16 possesses four letter characters 18.

Figure 5:
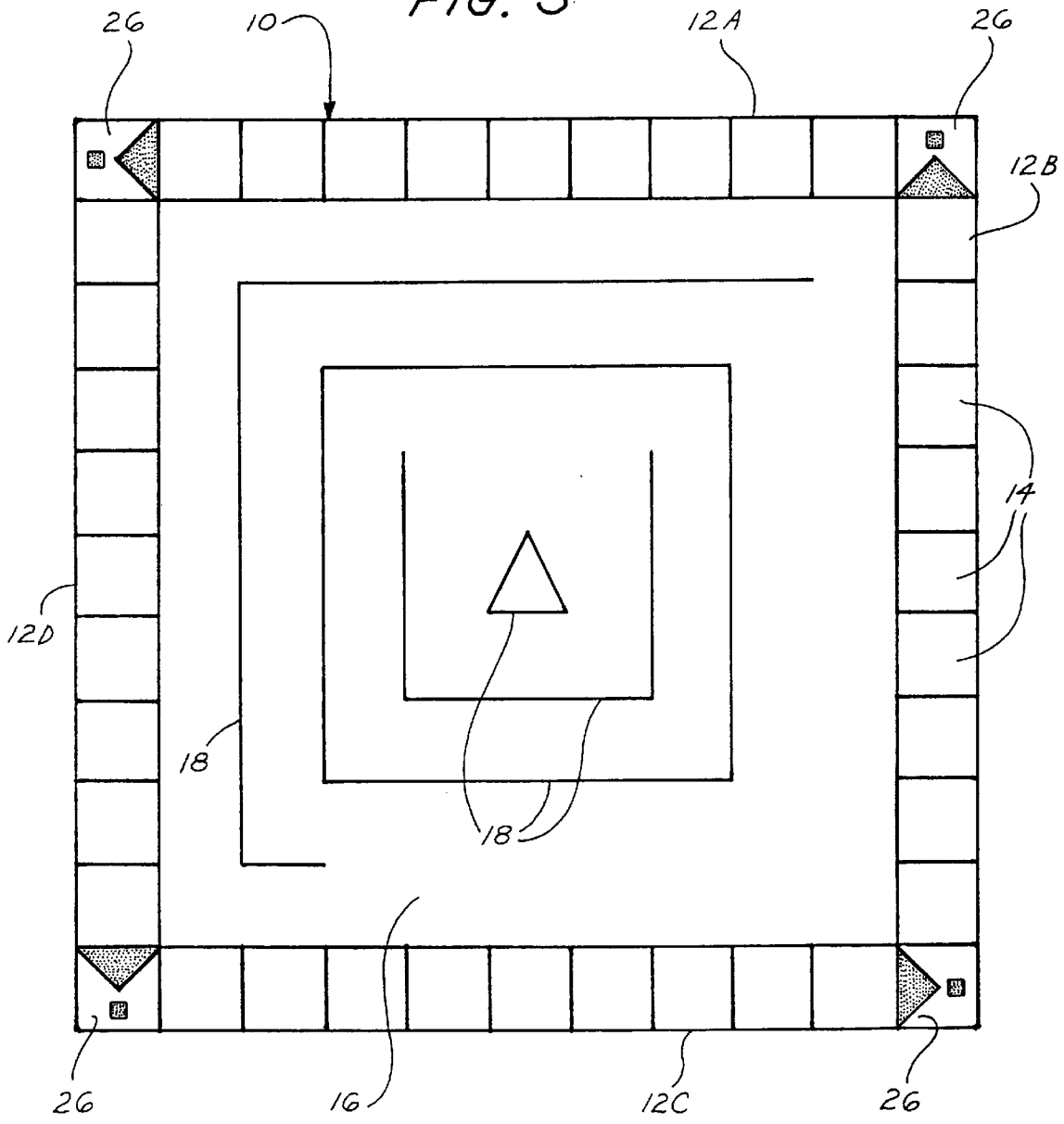
FIG. 5 illustrates yet another word puzzle card, with information contained within the matrix of spaces pertaining to the arrangement of letter characters found within the center of the word puzzle card.

In FIG. 5, alternate information is supplied within the grid spaces 14 of the information relaying means. At each corner grid space 14 of the word puzzle card 10, or at any other grid space 14 on each side 12 of the card 10, card orientation indicia 26 is supplied. The card orientation indicia 26 informs the player as to which way the card 10 should be oriented (i.e. which side 12 should be considered the "top") in order to properly read each separate letter character 18. For instance, one of the orientation indicia 26 would inform the player that to read the first letter character beginning from the outer edges 12 inward, the card must be oriented so that side 12B is caused to be on top. Upon doing so, the player would comprehend that the first character letter 18 comprises an "L", and so forth.

Figure 6:
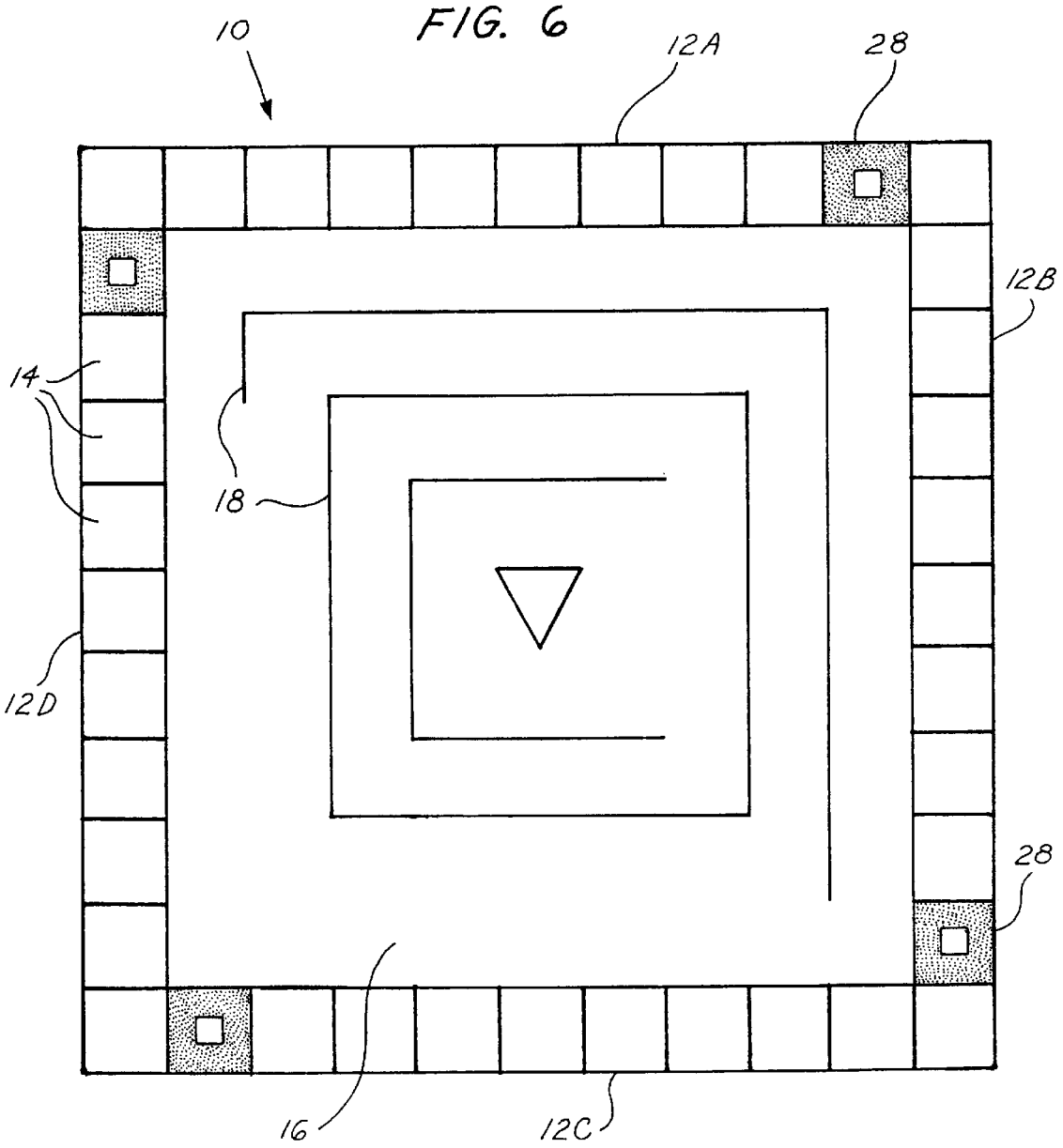
FIG. 6 depicts yet another word puzzle card.
Figure 7:
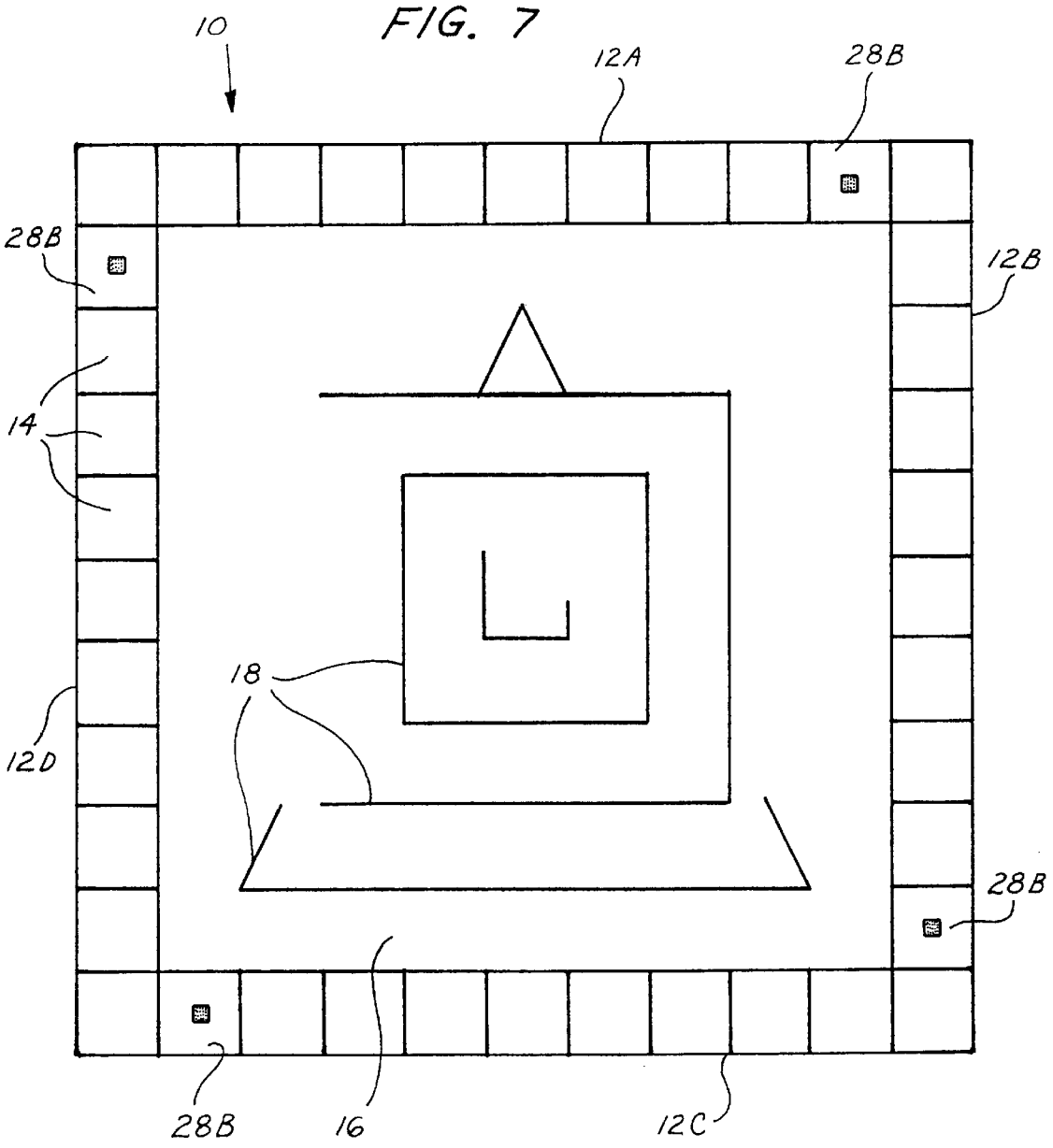
FIG. 7 depicts another word puzzle card having a varied configuration and arrangement of letter characters within the center thereof.

Further information is supplied within the grid spaces 14 in FIG. 6. A graphic image 28 is found within the grid spaces 14 on each side 12 of the word puzzle card 10. The graphic image 28 of FIG. 6 indicates that the word or phrase found within the display area 16 should be read from the outer area of the display area 16 proximal to the grid spaces 14 inward, toward the center of the word puzzle card 10. The graphic image 28B of FIG. 7, conversely, indicates that the word configured within the display area 16 should be read beginning from the center outward. It should be noted regarding FIG. 7 that the outer letter characters 18 do not overlap or cross the paths of the more inner letter characters 18 (the outermost letter character 18, which is a "d" does not overlap or cross the path of the next most inwardly letter character 18, which is a "u"). It should be further understood that additional line appendages may be added to or subtracted from the standard letter characters 18 to further encrypt said letter characters 18, thus causing the word puzzle game to be more challenging.

The instant invention further contemplates the use of a game board (not shown) having a series of progress spaces wherein players proceed forward along the progress spaces towards an ultimate winning position. The progress forward along the spaces is dependent upon each respective player's ability to decipher the variously arranged character letters 18 found within the display area 16 of the word puzzle cards 10. It is envisioned, with regard to the game board aspect of the instant invention, that a plurality of word puzzle cards 10 will be supplied therewith, each of said cards 10 having different words, phrases and configurations of letter characters 18 arranged thereupon.

What is claimed is:

1. A word puzzle game apparatus, an object of the word puzzle game apparatus being to decipher an encrypted word, the word puzzle game apparatus comprising:

a) a word puzzle card, having a plurality of sides, an outer periphery, and a geometric center;

b) a matrix of grid spaces, surrounding the outer periphery of the word puzzle card;

c) a display area located upon the word puzzle card, said display area framed by the matrix of grid spaces which surround the outer periphery of the word puzzle card; and d) a plurality of letter characters, nested within the display area such that a letter character located in the outermost area of the display area is largest in size with respect to the other letter characters found within the display area, comprising a recognizable word to be deciphered by a player, and successive letter characters are placed in distinct zones progressively closer to the geometric center of the word puzzle card, with each successively inwardly approaching letter character smaller than the previously, more outwardly placed letter character, such that said letter characters never overlap.

2. The word puzzle game of claim 1, wherein the word puzzle card is rectangular in shape.

3. The word puzzle game of claim 2, wherein information is provided within the matrix of grid spaces regarding the recognizable word which is encrypted within the display area, said information intended to assist a player in deciphering the recognizable word.

4. The word puzzle game of claim 3, wherein the information provided within the matrix of grid spaces regarding the recognizable word encrypted within the display area comprises a plurality of symbols, said symbols representing particular letter characters found within the display area, thus assisting a player in deciphering the encrypted word in the display area.

5. The word puzzle game of claim 4, wherein the information provided within the matrix of grid spaces regarding the word encrypted within the display area further comprises orientation indicia to assist a player in orienting the word puzzle card correctly in order to decipher the letter characters found within the display area.

6. The word puzzle game of claim 5, wherein the information provided within the matrix of grid spaces regarding the word encrypted within the display area further comprises a graphic image which informs the player of the order in which to decipher the word found within the display area.

* * * * *